United States Patent [19]

Kuechler

[11] 3,952,640

[45] Apr. 27, 1976

[54] APPARATUS AND METHOD FOR EXTRACTING GREASE AND SMOKE, AND METHOD OF INSTALLING THE SAME

[75] Inventor: Irvin R. Kuechler, San Bernardino, Calif.

[73] Assignee: Vent-Cair, Inc., San Bernardino, Calif.

[22] Filed: Sept. 26, 1974

[21] Appl. No.: 509,555

Related U.S. Application Data

[63] Continuation-in-part of Ser. No. 336,970, March 1, 1973, abandoned, and a continuation-in-part of Ser. No. 497,690, Aug. 15, 1974.

[52] U.S. Cl. ..... 98/115 K; 55/422; 55/DIG. 36; 126/299 A; 126/299 B

[51] Int. Cl.[2] ..... F23J 11/00

[58] Field of Search ..... 55/242, 422, DIG. 36; 126/299 A, 299 B; 98/36, 115 R, 115 K

[56] References Cited

UNITED STATES PATENTS

| | | | |
|---|---|---|---|
| 2,862,437 | 12/1958 | Smith et al. | 98/115 K |
| 3,131,687 | 5/1964 | Kalla | 98/115 K X |
| 3,285,154 | 11/1966 | DeRosa | 98/115 K |
| 3,380,369 | 4/1968 | Allander | 98/36 |
| 3,400,649 | 9/1968 | Jensen | 98/115 K |
| 3,457,850 | 7/1969 | Sweet et al. | 98/115 K |
| 3,490,206 | 1/1970 | Doane | 55/242 |
| 3,513,766 | 5/1970 | Ahlrich | 98/115 K |
| 3,520,115 | 7/1970 | Bowen | 55/422 |
| 3,664,255 | 5/1972 | Kuechler | 98/115 K |

*Primary Examiner*—William E. Wayner
*Assistant Examiner*—Ronald C. Capossela
*Attorney, Agent, or Firm*—Richard L. Gausewitz

[57] ABSTRACT

A greatly extended plenum chamber, comprising a plenum or exhaust chamber and a plenum extension connected thereto, is employed in combination with grease filters which operate by impingement and by centrifugal action. Furthermore, a stream of air is directed against the upstream surfaces of the filters. The result of the combination is a surprisingly effective removal of grease and smoke from cooking fumes, with consequent minimization of grease coatings on the surfaces of the plenum chamber and of the exhaust blower connected thereto. When space does not permit vertical installation of a large extended plenum chamber, portions of such chamber may be inclined from the vertical and/or may be replaced by a plurality of smaller plenum extensions.

In an additional embodiment, the effect of a very large plenum extension is obtained by a single and much smaller plenum extension. This is achieved by (a) using a duct (to the exhaust blower) which has a diameter larger than the depth of the plenum extension, and (b) placing a relatively small air deflector below the connection between such duct and the plenum extension.

Other features of the apparatus and method include (a) a unitary construction which is substantially completed at the factory and is easily and unitarily installed at the job site by dropping it into a hole in the ceiling, and (b) an electrostatic precipitator which is sometimes employed where smog regulations are particularly stringent.

8 Claims, 9 Drawing Figures

APPARATUS AND METHOD FOR EXTRACTING GREASE AND SMOKE, AND METHOD OF INSTALLING THE SAME

CROSS REFERENCE TO RELATED APPLICATION

This application is a continuation-in-part of my prior application Ser. No. 336,970, filed Mar. 1, 1973 now abandoned. This application is also a continuation-in-part of my copending patent application Ser. No. 497,690, filed Aug. 15, 1974, for an Apparatus for Removing Fumes from the Space Above a Cooking Appliance in a Restaurant.

BACKGROUND OF THE INVENTION

1. Field of the Invention

This invention relates to the field of smoke hoods for removing grease and smoke from the spaces above cooking appliances, particularly in restaurants. It further relates to a method of installing such hoods.

2. Description of Prior Art

The removal of grease and smoke from the cooking fumes passing upwardly from cooking appliances in restaurants or the like is notoriously inefficient and ineffective, particularly if the grease filters are not frequently and properly cleaned. (In the latter connection, it is emphasized that many restaurant employees do not do a sufficiently frequent or adequate job of filter cleaning or maintenance.)

The results of such poor filtering are several, and are serious. For example, the large quantities of grease which pass upwardly from the filters form thick grease coatings on the interior surfaces of chambers and ducts, on the blower parts, and sometimes on the adjacent exterior portions of the restaurant building. The result is an unsanitary mess, which creates a distinct fire hazard. Frequent cleanings are therefore required, and fire insurance rates are increased.

As another example, the grease particles in the air constitute a major factor in "smoke," which is beginning to be proscribed by air pollution laws and regulations. If there were no grease in the exhausting air, there would be relatively little "smoke," and the air pollution regulations would usually be met. There is now on the market apparatus, of the electrostatic-precipitor variety, for removing grease and other particles from the air passing upwardly from a restaurant cooking appliance. Such apparatus is very costly, and requires frequent and difficult cleaning particularly since it rapidly becomes coated with grease.

Prior-art reference is hereby made to my U.S. Pat. No. 3,664,255, issued May 23, 1972 for an Apparatus and Method for Removing Fumes from the Space Above A Cooking Appliance, and also to Pat. No. 3,566,585, issued Mar. 2, 1971, for a Grease-Extracting Apparatus, inventors Mona A. Voloshen and Danny B. Deavor. Elements of these patents form elements of certain embodiments of the present invention, as set forth below.

Another element of all embodiments of the present invention is a greatly extended exhaust or plenum chamber. The exhaust or plenum chambers of prior-art smoke hoods known to applicant were rather small, and/or were disposed entirely in the room wherein the smoke hood was located. Such chambers were connected by ducts (for example, the ducts or conduits 43, FIG. 4, of said U.S. Pat. No. 3,664,255) to the exhaust blower on the roof of the building.

It is generally a building or safety code requirement that the lineal velocities of the exhaust air flowing through such ducts be very high, normally in excess of 1500 feet per minute. To achieve such high lineal velocities, and to simplify the problem of penetrating the ceilings of the restaurant kitchens, the ducts are conventionally quite small in cross-sectional areas and cannot be regarded as extended exhaust or plenum chambers. Applicant has discovered that great benefits are achieved by going contrary to the building or safety codes, in that the exhaust or plenum chamber is greatly extended so that the lineal air velocities are not so high. Such high lineal velocities are normally only achieved, with applicant's apparatus and method, relatively near the exhaust blower.

By employing the greatly extended exhaust or plenum chamber, applicant achieves uniformity relative to air flow across the entire width of the apparatus, and minimization of grease coatings on the various surfaces. (It is emphasized that many grease hoods are ten or twenty feet wide, or wider, and that the air flow must be substantially uniform across the entire width if highly effective filtration is to be achieved.) The relatively uniform drawing or sucking of air through the filters is combined with relatively uniform forced-flow of air against the upstream filter surfaces. It is also, in some embodiments, combined with filters which operate by both impingement and centrifugal action. The result of the combination is a great, surprising removal of grease and smoke, economically and with minimum requirements for filter cleaning and other maintenance. These benefits are added to the benefits emphasized most strongly in U.S. Pat. No. 3,664,255, namely the prevention of waste relative to cooled or heated room air.

Relatively uniform air flow, across the entire width of the apparatus, may be achieved, by the present invention, without following either of the following two approaches (both of which were employed in the prior art): (a) adjusting the filters differently at different points across the width of the apparatus, and (b) placing screens or baffles or the like in the plenum adjacent the filters or in connecting ducts. Approach (a) (which has been employed by prior art workers in conjunction with the filters of the above-cited U.S. Pat. No. 3,566,585) is undesirable in that the adjustment impairs filtration in certain regions. Approach (b) (also in the prior art) is unsatisfactory for reasons including the fact that the screens plug up with grease, and baffles (unless employed in an extended plenum) do not do the job satisfactorily and/or collect grease excessively. Reference is made to the above-cited U.S. Pat. No. 3,664,255 at column 5, lines 24 et. seq., wherein baffles are mentioned.

Relative to another aspect of the prior art, that of installing the hood, this has always (insofar as applicant is aware) been a multi-step operation. The hood is first manufactured at a factory, then moved into the restaurant through a hole in a side wall (which hole must later be filled). Then the hood is lifted up toward the ceiling, and local (highly expensive) sheet metal men install and connect the blowers and ducts. In the case of the present extended-plenum apparatus, such local fabrication and/or installation of the plenums has proved to be a major problem since it tended to be done incorrectly. After installation, it was necessary to perform testing and make adjustments. It is therefore of major importance that the entire apparatus (including extended plenums) by fully manufactured and fully tested at the factory, then installed at the restaurant with no necessity for local sheet metal workers or for a hole in the restaurant side wall.

SUMMARY OF THE INVENTION

The exhaust or plenum chamber of the present smoke hood (and method) is large and wide, being normally extended upwardly through the ceiling of the kitchen by a plenum extension. Such chamber passes air from impingement-centrifugal grease filters to an exhaust blower means located on the roof. Forced-flow air is directed in a relatively uniform manner against the upstream surfaces of the grease filters, to aid greatly in the relatively uniform passage of air therethrough. Such forced-flow air is, in the preferred embodiment, primarily make-up air supplied directly from the exterior of the building — not cooled or heated air from the kitchen.

Portions of the extended plenum chamber may be inclined from the vertical so as to be either above or below the horizontal. A plurality of smaller side-by-side plenum extensions may be utilized when it is impractical to employ a single large plenum extension. Where smog regulations are expecially stringent, an electrostatic precipitator may be incorporated.

According to one embodiment of the invention, the effect of a very tall plenum extension is achieved without the need for the above-mentioned plurality of side-by-side extensions and associated ducting. This is accomplished by using restrictor means in the plenum extension, preferably near the outlet to the exhaust blower duct. Such outlet is caused to have a diameter much greater than the thickness of the plenum extension. Great savings in cost and space are thereby achieved.

To vastly reduce costs, mistakes, installation time, etc., the entire apparatus is manufactured and pretested at the factory, then dropped into place at the restaurant through a hole in the roof. Part of the apparatus extends downwardly from the hole, and part extends upwardly therefrom.

DETAILED DESCRIPTION OF THE PREFERRED EMBODIMENTS

EMBODIMENT OF FIGS. 1-3

The entire disclosure of said U.S. Pat. No. 3,664,255, is hereby specifically incorporated by reference into the present application, as if set forth in full herein, with the following exceptions: (a) Elements 43, FIG. 4 of said patent, are replaced by the extended exhaust or plenum chamber shown in FIG. 2 of the present drawings, (b) Grease filters 20 of said patent are replaced by grease filters 3*a* (FIG. 3 of the present drawings). The disclosure of said U.S. Pat. No. 3,664,255 is preferably modified as set forth in said copending patent application Ser. No. 497,690, filed Aug. 15, 1974, for an Apparatus for Removing Fumes from the Space Above a Cooking Appliance in a Restaurant. Such patent application Ser. No. 497,690 is also hereby incorporated by reference herein, as though set forth in full.

Figure 5:
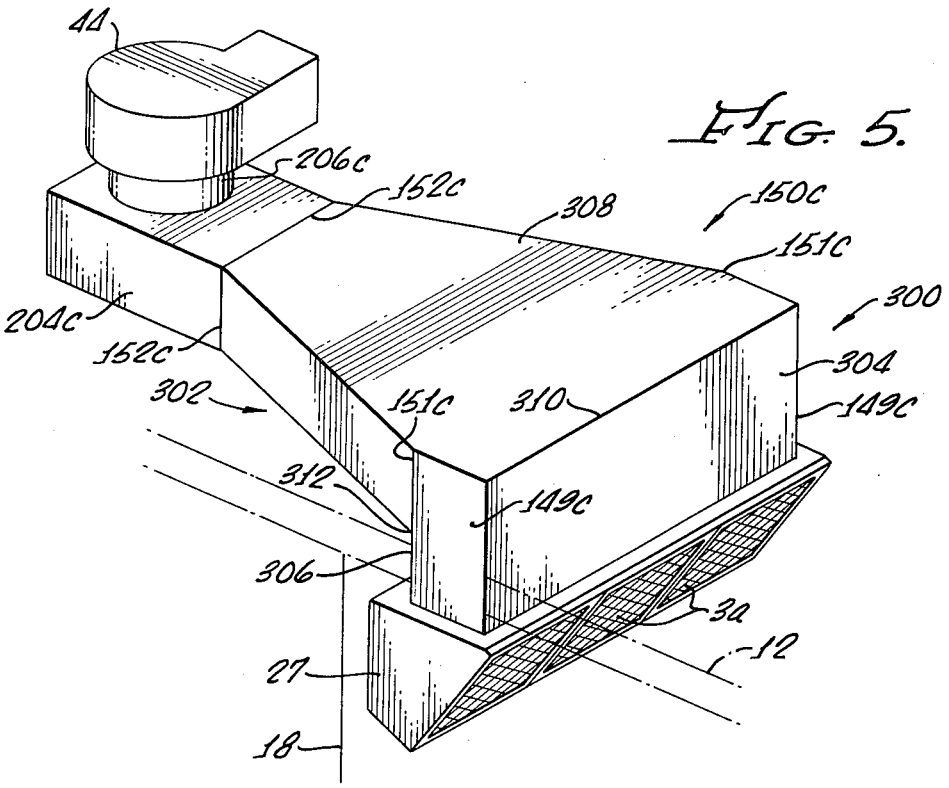
FIG. 5 is an isometric view of an apparatus wherein nearly horizontal portions of a plenum extension are provided above the plenum chamber.

The disclosure of said U.S. Pat. No. 3,566,585 relating to the construction of each individual filter 3*a* is hereby specifically incorporated by reference into the present application, as if set forth in full herein. Said filters are numbered 3a in the present application, and are preferably operated in the open mode (FIG. 4 of said patent) not the closed mode (FIG. 5 thereof). The degree of opening (i.e., the setting) is therefore uniform across the entire width of the apparatus, being based upon filtering efficiency.

Figure 1:
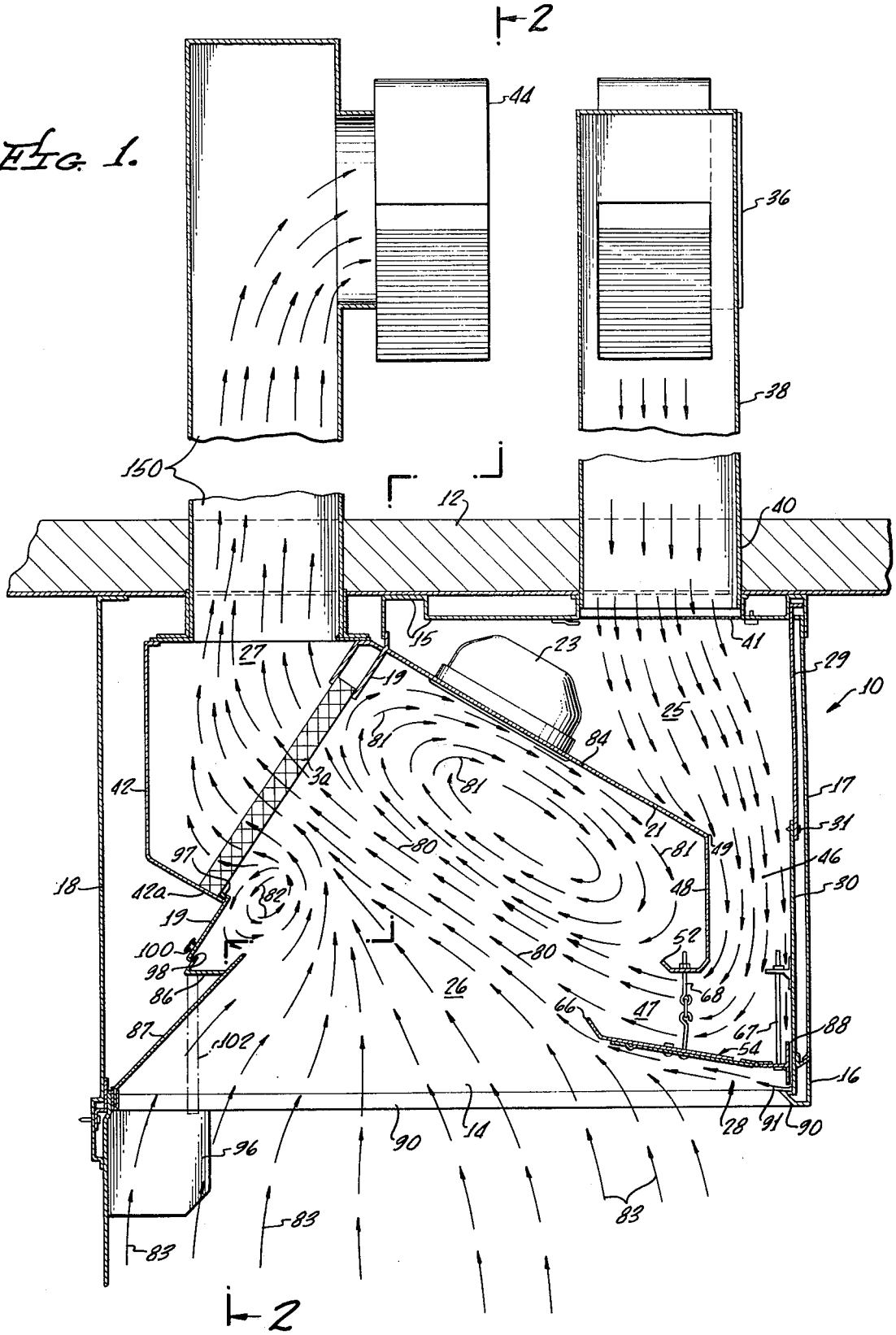
FIG. 1 is a vertical sectional view of the smoke hood apparatus, the grease filters being shown schematically, said figure corresponding substantially to FIG. 2 of U.S. Pat. No. 3,664,255.
Figure 2:
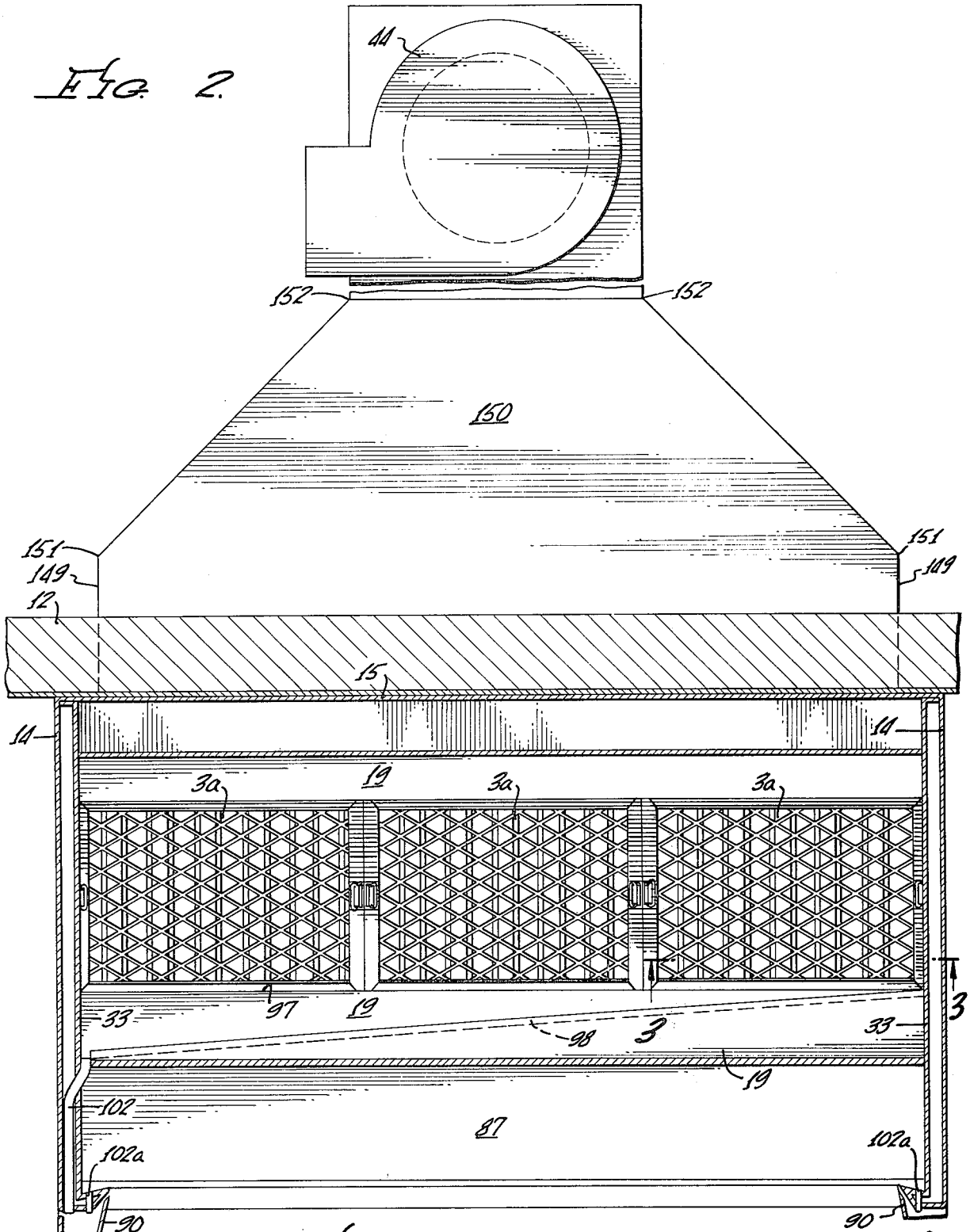
FIG. 2 is a vertical sectional view on line 2—2 of FIG. 1.
Figure 3:
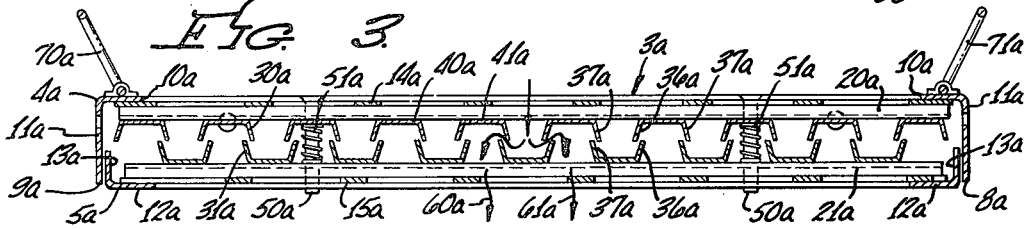
FIG. 3 is an enlarged horizontal sectional view on line 3—3 of FIG. 2, and corresponding substantially to FIG. 4 of U.S. Pat. No. 3,566,585, each number of such FIG. 3 being followed by the letter "*a*;"

Referring to FIGS. 1 and 2 of the drawings of the present application, the "exhaust chamber" or plenum chamber 27 does not communicate with exhaust ducts or conduits (numbered 43 in U.S. Pat. No. 3,664,255), but instead communicates with an exhaust or plenum chamber extension 150 which passes upwardly through ceiling 12. Together, the exhaust or plenum chamber 27 and the plenum extension 150 form a greatly extended exhaust or plenum chamber, which may be referred to as an extended plenum chamber. The forward and rear walls of the illustrated plenum extension 150 are vertical, and the lower side wall portions 149 (FIG. 2) of such extension are also vertical. A large part of the lower wall portion of the exhaust or plenum chamber 27 is formed by filters 3*a*.

Above the lower side wall portions 149 are disposed inwardly converging or inclined side wall portions, shown in FIG. 2. Each of these converging portions extends from a lower edge 151 to an upper edge 152, the latter edges being relatively adjacent the intake to exhaust blower 44.

The extended exhaust or plenum chamber 27–150 extends upwardly sufficiently far to achieve a uniform air flow across substantially the entire width of the smoke hood.

The plenum extension 150 is open at its bottom, communicating with the exhaust or plenum chamber 27 across substantially the entire width of the apparatus. Wall portions 149 should not be indented inwardly more than a few inches (for example, 4 or 5 inches) from inner panel portions 33 (see FIG. 2).

The vertical dimensions of lower side wall portions 149, and/or the convergence of the inclined side wall portions, are related to the width of the smoke hood (the "width" being the horizontal distance between inner panel portions 33, as seen in FIG. 2). Where such width is great, for example 15 to 20 feet, the vertical dimensions of wall portions 149 are made relatively large, and/or the inclined side wall portions (between edges 151–152) are made quite converging. Where such width is less great, for example 5 to 10 feet, the vertical dimensions of wall portions 149 can be small or even zero, and/or the converging side wall portions can be more nearly parallel.

In a typical installation, each edge 151 is at least two feet above the upper edges of filters 3*a*. Thus, the vertical dimension of each lower vertical side wall portion 149 is at least 2 feet minus the vertical distance from the bottom edge of wall 149 to the upper edges of filters 3*a*. Also, in a typical installation, the angle of convergence of each inclined side wall portion (between edges 151–152) is no more than 45° from the vertical.

The extended plenum chamber of FIGS. 1–3 achieves a substantially uniform air flow across the entire width of the apparatus, without the necessity of employing any auxiliary screens or baffles, etc. Such screens, baffles, etc., are very difficult to adjust and, very importantly, are disadvantageous in that they provide air obstructions and collect grease. Screens, intended to regulate air flow, are particularly bad in that holes therein become grease-plugged and are (in most restaurants) not cleaned adequately, if at all. (However, as described below relative to FIGS. 7–9, small factory-installed baffle means in the plenum extension are of major benefit in certain constructions.)

Stated generally, the present method comprises employing an exhaust blower to draw air through a greatly extended exhaust or plenum chamber and thus through grease filters which are disposed above a cooking appliance. The plenum extension 150 extends upwardly sufficiently far above the filters that the air flow through the filters is substantially uniform across the entire width of the apparatus. Air velocities in the extended plenum chamber are relatively low, due to the large cross-sectional area thereof. With applicant's apparatus and method, the lineal air velocities in the portions of plenum extension 150 remote from exhaust blower 44 are less than 1500 feet per minute. The air does not accelerate greatly as it passes through ceiling 12.

Stated more specifically, the present method comprises employing a supply blower to effect high-velocity forced flow or air and smoke against the upstream sides of the grease filters, and in a relatively uniform manner. The supply blower, in the preferred embodiment, derives its air directly from the exterior of the building, as distinguished from using heated or air-conditioned "room air." The method further comprises, in its preferred form, using the type of grease filter which effects an abrupt change or reversal of air flow direction, so that grease extraction is effected centrifugally as well as by impingement. In addition, the method comprises (in its preferred form) employing the vortexing action described at length in U.S. Pat. No. 3,664,255, and illustrated at 81 and 82, FIG. 1 of the present application.

Since, in the preferred form of the present method and apparatus, the great bulk of the air which passes through the filters 3a comes directly from the exterior of the building, the kitchen air (furnace heated or air-conditioned) is not wasted. Such make-up air from the exterior of the building is force-blown (by blower 36) at high velocity, and relatively uniformly, against the upstream surfaces of the grease filters. The particles of "sooty grease" which convect upwardly from the cooking stove are entrained in the rapidly-moving make-up air, and thus impinge at high speeds against the upstream surfaces of the grease filters. Furthermore, the make-up air chills the grease particles, which enhances the filtering action.

A major filtering action is therefore achieved due to impingement of the chilled grease against the upstream surfaces of the grease filters. In addition, there is a further important filtering action caused by the centrifugal "throwing" of the chilled grease particles against the filter surfaces due to the rapid direction change as the air passes through filters 3a. The latter or centrifugal action is effected by the exhaust blower 44, acting through the plenum chamber 27 and its major upward plenum extension 150.

The action of exhaust blower 44 is particularly effective in that there is no need for providing flow-regulating screens, etc., in the plenum chamber and which tend to become clogged with grease. The above-described uniform flow through the grease filters, across the entire width of the apparatus, is of great importance in achieving highly effective filtering.

Accordingly, a high percentage of grease and smoke particles are removed by the filters, instead of passing upwardly to coat various surfaces and pollute the air. There are no adjustments to be made in the plenum chamber 27 or its plenum extension 150, nor is there any necessity for frequently cleaning the same. Since the collected grease runs downwardly off the grease filters (to be collected in containers), the present apparatus can operate for months at a time with little or no maintenance.

It is within the scope of the invention to orient the duct from plenum extension 150 to exhaust blower 44 horizontally instead of vertically. Thus, for example, the blower 44 may be mounted on the upper surface of ceiling 12, adjacent the center of plenum extension 150. A short horizontal duct is then extended from the blower to the plenum extension. Such duct is, for example, perpendicular to the plane of the showing of FIG. 2, and may communicate with the plenum extension at the point where the number "150" now appears on FIG. 2.

EMBODIMENT OF FIG. 4

Figure 4:
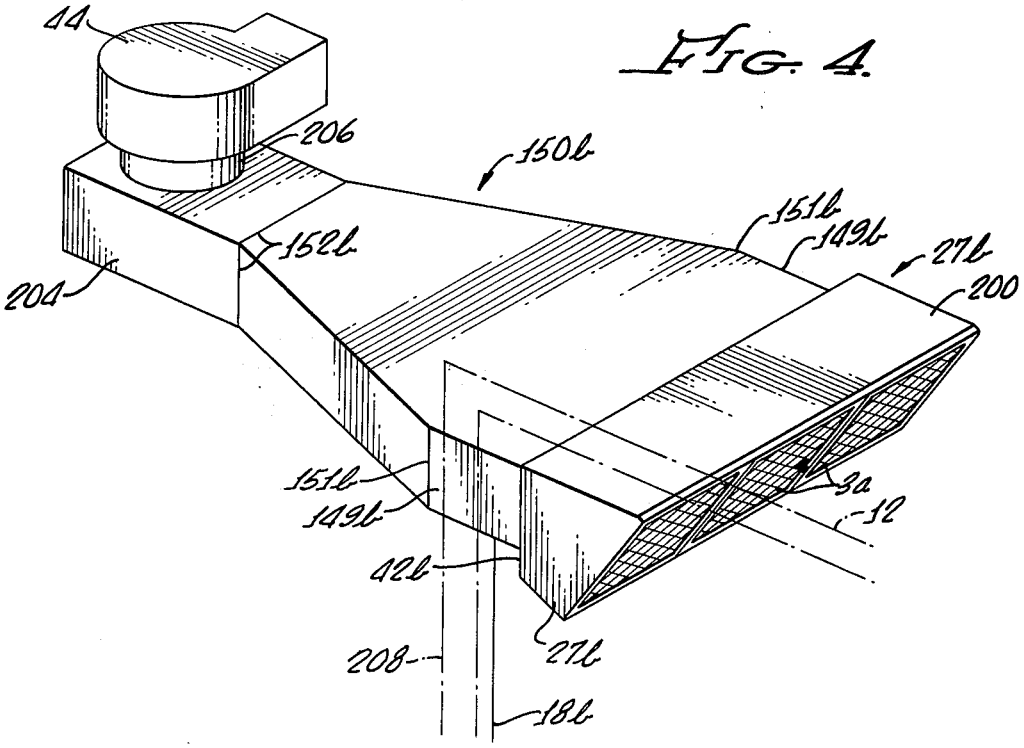
FIG. 4 is an isometric view of an apparatus wherein a nearly horizontal plenum extension extends outwardly through a wall rearwardly of the plenum chamber.

Instead of extending vertically, all or part of the extended plenum may be bent or inclined away from the vertical. For example, as illustrated in FIG. 4, a plenum extension is disposed nearly horizontally, rather than vertically, and projects rearwardly from the smoke hood so that obstructions above the smoke hood may be avoided or so that the plenum extension will not project upwardly beyond a low roof parapet. Such plenum extension is substantially identical to that previously described, the only differences being those required to effect a rearward rather than an upward installation. Furthermore, the entire smoke hood apparatus (except for the inclination of the plenum) is identical to that previously described.

For purposes of description, features and elements identical to those previously described will be identified by the previously used reference numbers. Corresponding elements and features will be identified by the original reference numbers followed by the letter "*b*." New elements and features, or those not previously identified by reference numbers, will be given reference numbers in the 200 series.

An exhaust or plenum chamber **27*b* is formed the entire width of the filters 3*a*, being identical to the previously described plenum chamber 27 except that an upper surface 200 thereof is closed and the inner wall 42*b* thereof has an opening to receive the forward end of a plenum extension 150*b***.

The plenum extension **150*b*, shown extending rearwardly from the plenum chamber 27*b*, is substantially identical to the previously described plenum extension 150. Parallel wall portions 149*b* at a forward end of the plenum extension 150*b* are spaces apart substantially the width of the plenum chamber 27*b*. Nonparallel sides converge rearwardly from edges 151*b*, which are adjacent to wall portions 149*b*, to edges 152*b***, which are located rearwardly therefrom.

The rearward end of the plenum extension **150*b* terminates in a rectangular duct portion 204, which has an upper opening to which a generally vertical duct 206 is attached. The exhaust blower 44 is connected at the upper end of the duct 206,** being shown mounted horizontally and having a vertical axis of blower rotation.

The exhaust blower 44 may alternatively be connected to the rearward end of the duct 204, the only limitation being that the axis of rotation of the blower should be either vertical (as shown) or horizontal for optimum operation of the blower.

Forward ends of the parallel upper and lower surfaces of the plenum extension **150*b*, and forward ends of the wall portions 149*b*, are attached at the rearward facing opening in the inner wall 42*b* of the plenum chamber 27*b*. The plenum extension 150*b* projects nearly horizontally, rearwardly through an opening in the rear wall 18*b* of the smoke hood and through an opening in a vertical wall 208 of the building. The plenum extension 150*b* may, however, be constructed so as to be at any slope either above or below the horizontal, the only limitation being that such slope should be at least ± ¼ inch per foot of length to assure proper drainage and prevent grease buildup. The plenum extension may (as indicated) incline or extend downwardly, away from the main plenum 27*b***, but this is usually undesirable in that grease then drains away from the smoke hood apparatus instead of toward the same.

EMBODIMENT OF FIG. 5

In some circumstances, because of space limitations or adjacency of other rooms or buildings, it may be impossible or impractical to employ either a vertically disposed plenum extension or an inclined plenum extension. Accordingly, it may be desirable or necessary to bend the plenum extension and install some portions thereof inclined from the vertical. Such an embodiment is exemplified by FIG. 5, wherein lower portions of a plenum extension are shown vertically disposed above the smoke hood and upper portions are shown inclined to a nearly horizontal position.

For purposes of description, elements and features identical to those previously described will be identified by the previously used reference numbers. Corresponding elements and features will be identified by the original reference numbers followed by the letter "*c*." New elements and features, or those not previously identified, will be identified by reference numbers in the 300 series.

A bent plenum extension **150*c* is formed having a generally vertical portion 300 and a nearly horizontal, rearwardly directed portion 302. The portion 300 is formed of parallel, vertical side wall portions 149*c* which are spaced apart about the width of the exhaust or plenum chamber 27, and of parallel, vertical front and rear wall portions 304 and 306.**

The portion 302 is formed by sides which converge inwardly from edges **151*c* adjacent wall portions 149*c* to edges 152*c* rearwardly thereof. An upper surface 308 extends forwardly to the upper edge 310 of the front portion 304. A parallel lower surface extends forwardly to the upper edge 312 of the back portion 306. A continuous plenum extension is thereby formed which is open only at a lower end and at a rearward end. A duct 204*c*, having a generally vertical duct 206*c* attached thereto, is connected to such rearward end. The exhaust blower 44 is horizontally mounted at the open upper end of the duct 206*c***.

The lower portion 300 of the plenum extension is attached at a lower end to an opening in the upper surface of the plenum chamber 27, and projects upwardly through ceiling 12. The upper portion 302 of the plenum extension projects rearwardly and almost horizontally above the ceiling 12.

Depending upon installation requirements, the lower portion 300 may be inclined from the vertical and the upper portion 302 may be sloped either above or below the horizontal, the only limitation being that the slope of the portion 302 should be at least ± ¼ inch per foot of length to assure adequate drainage.

EMBODIMENT OF FIG. 6

Figure 6:
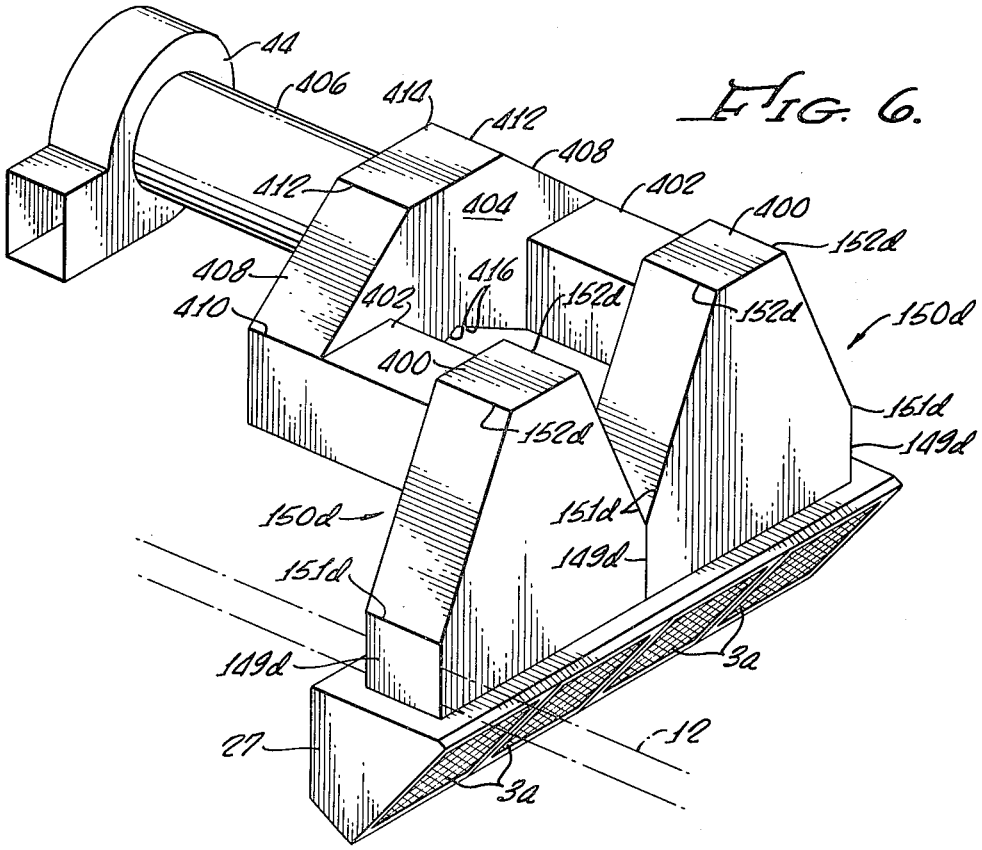
FIG. 6 is an isometric view showing an interconnected pair of plenum extensions which replace a single larger plenum extension.

It may be impractical or undesirable in some circumstances to use a single extended plenum chamber in either the vertical, inclined or bent configurations described above, because of the great width of the smoke hood. By substituting a plurality of side-by-side plenum extensions, as illustrated in FIG. 6, the width of each extended plenum chamber may be greatly reduced. Much vertical space may thus be saved when the smoke hood is disposed over a very wide cooking appliance.

For purposes of description, elements and features identical to those previously described will be identified by the previously used reference numbers. Corresponding elements and features will be identified by the original reference numbers followed by a letter "d." New elements and features, or those not previously identified, will be identified by reference numbers in the 400 series.

As illustrated in FIG. 6, two vertically disposed plenum extensions **150*d* are connected in side-by-side relationship to an opening in the upper surface of the plenum chamber 27, and extend upwardly through ceiling 12. Both such plenum extensions are identical to each other, and each is substantially identical to the single, vertically disposed plenum extension 150 previously described. Each plenum extension 150*d* has a lower portion defined by wall portions 149*d*, sides which converge from lower edges 151*d* to upper edges 152*d*, and parallel front and rear surfaces. The thickness of each plenum extension 150*d* is equal to that of a single plenum extension 150.**

Upper ends of the plenum extensions **150*d* are closed by surfaces 400, and the two plenum extensions are connected together and to a single exhaust blower 44 so that uniform air and fume flow may be achieved. Two ducts 402 are connected to the plenum extensions 150***d*, one duct being connected to an upper rear region of each such extension. The other ends of the ducts 402 are connected to lower, forward regions of a manifold or chamber 404. A duct 406 is connected between the manifold 404 and the exhaust blower 44.

The manifold 404 is preferably shaped similarly to a plenum extension in order to achieve a smooth flow of exhaust air and fumes therethrough and to assure a uniform flow of exhaust air and fumes through and across each plenum extension 150*d*. The lower width of the manifold 404 is approximately equal to the spacing between vertical centerlines of the plenum extensions 150*d* plus the width of one of the ducts 402. Upper sides 408 of the manifold 404 converge towards each other from lower edges 410 to upper edges 412. The upper portion of the manifold 404 is closed by a top 414. Bottom portions 416 of the manifold 404 are inclined upwardly, inwardly of the ducts 402, giving the manifold the general appearance of an inverted "V."

It is to be understood that the pairs of plenum extensions 150*d* may be inclined or bent as above described.

It is also to be understood that the smoke hoods, plenum extensions, etc., may be mounted in back-to-back relationship. This may be done, for example, when the cooking appliances themselves are back-to-back.

EMBODIMENT OF FIGS. 7–9

The embodiment of FIG. 6 has been employed by applicant when the smoke hood apparatus is very wide (such width being necessitated by the large number or size of the cooking appliances therebeneath). The purpose of the side-by-side construction of FIG. 6 is to achieve uniform flow through the filters, across the entire width of the apparatus, without causing the plenum extension means to be excessively high. (It is to be remembered that "width," in the present application, means horizontal distance from left to right as seen (for example) in FIG. 8. Such "width" may be in excess of 20 feet.)

Without substantially uniform flow through the filters, across the entire width of the apparatus, some filters will be operating properly and others improperly. Thus, uniform flow is highly important.

As shown in FIG. 6, the side-by-side orientation creates substantial additional ductwork, and sheet metal work, with attendant cost and need for roof space. It would thus be greatly desirable to achieve, in a single low-profile exhaust plenum extension, the effect of a high extension or of a pair of side-by-side extensions. This is accomplished with the embodiment of FIGS. 7–9.

Figure 9:
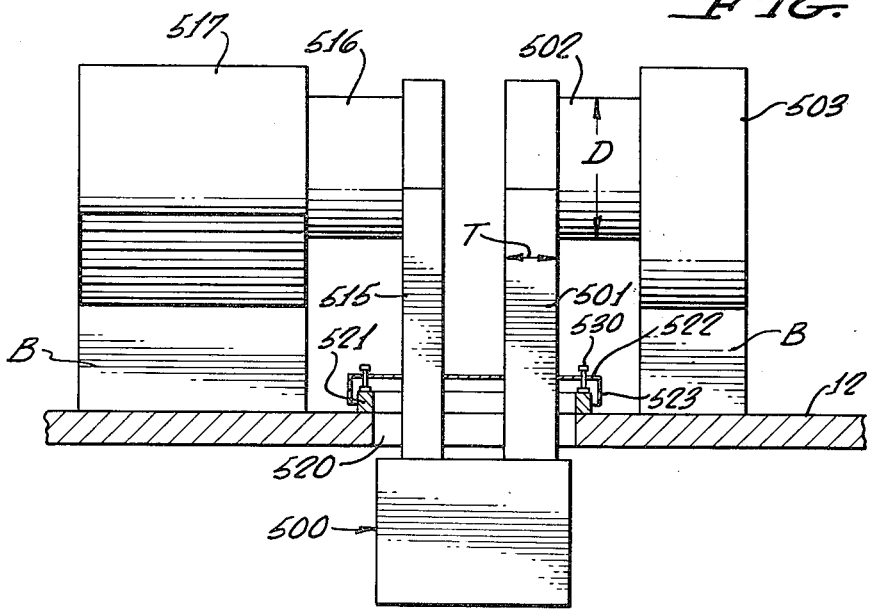
FIG. 9 is a side elevation of the apparatus of FIGS. 7 and 8, the roof or ceiling (and the combination support means and cover) being shown in section.
Figure 7:
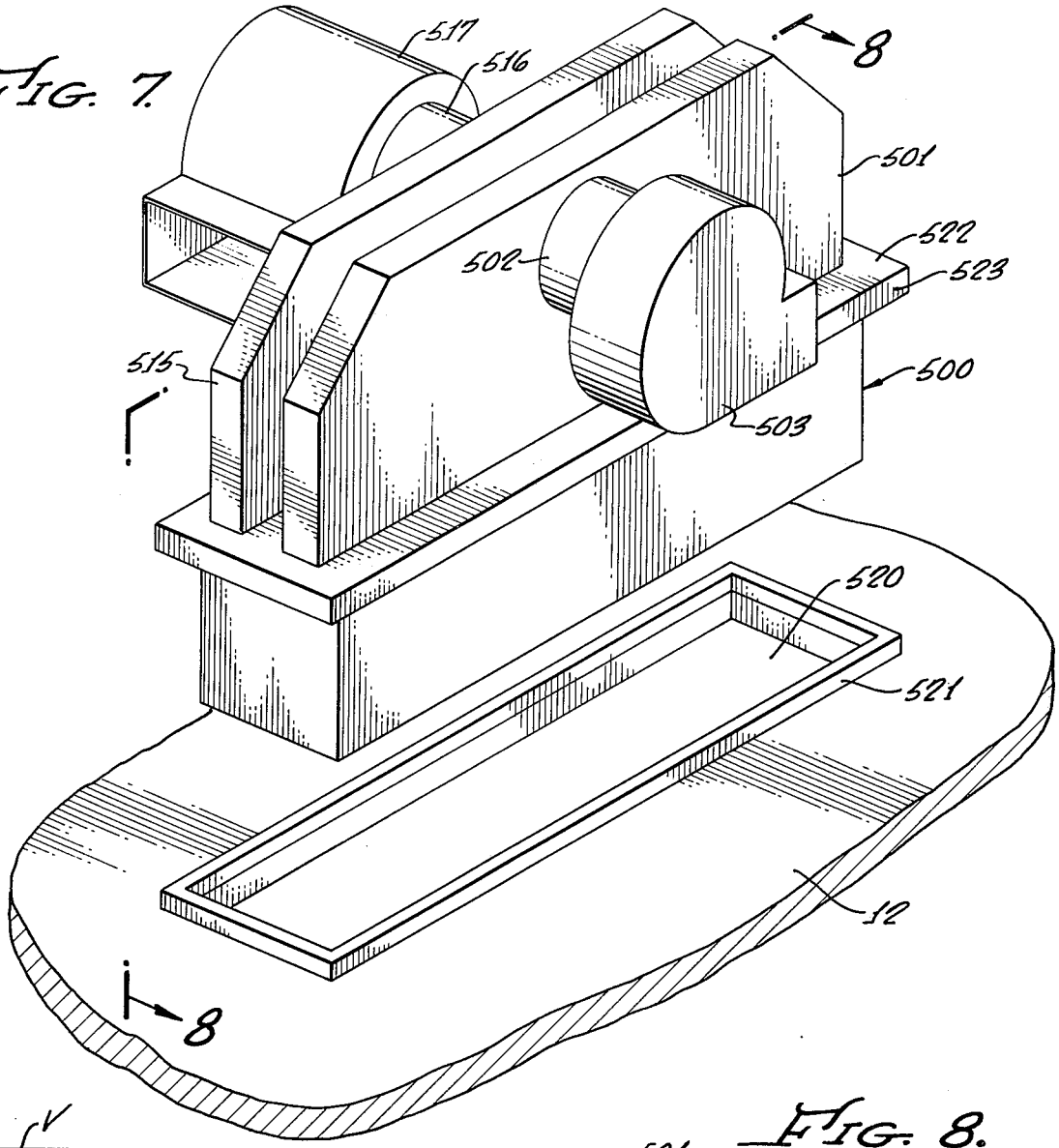
FIG. 7 is an isometric view illustrating a fully factory-constructed and factory-tested unitary smoke hood and extended-plenum apparatus, in the act of being dropped part way through a predetermined opening in the roof or ceiling of a restaurant kitchen.
Figure 8:
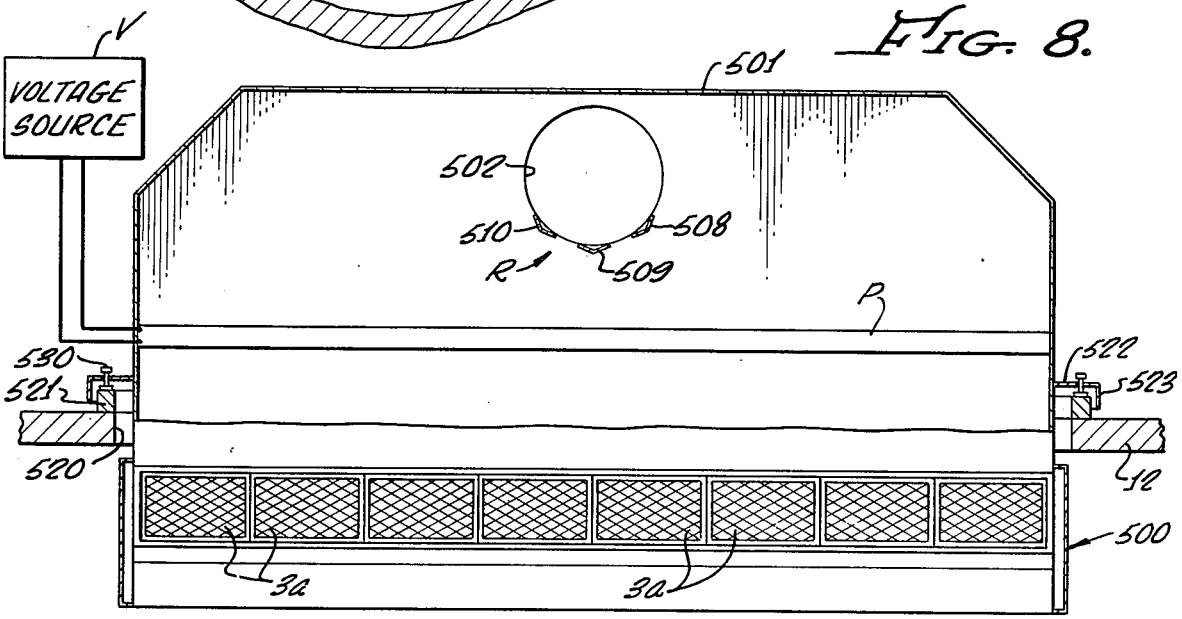
FIG. 8 is a vertical sectional view on line 8—8 of FIG. 7, after installation and leveling have been completed.

The embodiment of FIGS. 7–9 also solves another major problem. With such embodiment, applicant is for the first time given full control over the entire design and construction, there being no necessity for relying upon local sheet-metal fabricators (who may not follow applicant's specifications, thus causing the entire apparatus to malfunction). With the embodiment of FIGS. 7–9, applicant can pre-build and pre-test everything at the factory. The apparatus can then be rapidly installed by relatively unskilled personnel at the job site. the installation apparatus and method of FIGS. 7–9, which are described later in this specification, may also be employed with other embodiments of the present invention.

Referring first to FIG. 7, there is shown an extremely large smoke or grease hood 500 of the type described in the above-cited U.S. Pat. No. 3,664,255, as modified in accordance with the above-cited application Ser. No. 497,690. Such apparatus may be, for example, about 20 feet "wide" (distance from left to right, FIG. 8).

Connected to hood 500 at the factory, and extending upwardly therefrom, is a plenum extension 501. Such extension 501 is much less tall, considering the great "width" of the apparatus, than would be expected from the prior teachings in this specification. For example, and although the apparatus is (for example) about 20 feet "wide," the plenum extension 501 need only extend about 6 or 7 feet above ceiling 12 when the apparatus is fully installed as shown in FIG. 8. Fabrication and materials costs and problems associated with the extended plenum are, with the present embodiment, reduced in comparison to the embodiment of FIG. 7. The extension 501 may also be inclined, as described above, thus making it even lower in profile.

The plenum extension 501 need not be tall, despite the great "width" of the apparatus, because there is provided a means R (FIG. 8) to restrict or deflect flow to the exhaust duct 502 from the central regions of the exhaust chamber 27 (FIG. 1). Means R reduces flow velocity through the central (least remote) ones of filters 3*a*. The "central regions" refer to the regions of exhaust chamber 27 which are substantially directly below the duct 502 connecting to exhaust blower 503 (FIGS. 7 and 9). Such restrictor means R are provided relatively adjacent the duct 502, and therefore can be small and self-draining so that only a minimal maintenance problem (if any) is presented.

Another reason why the plenum need not be tall, despite the great "width" of the apparatus, is that the diameter of duct 502 is very large in comparison to the thickness or depth of the plenum extension 501. Referring to FIG. 9, for example, it will be noted that the diameter "D" of exhaust duct 502 is much larger than the thickness "T" of plenum extension 501. Because of this relationship, air and fumes drawn into duct 502 must enter it from all regions of plenum extension 501, not merely (for example) from the plenum extension regions directly beneath the duct.

As an example, in the above-mentioned exemplary construction wherein the apparatus is about 20 feet "wide," dimension "D" may be 30 inches and dimension "T" may be about one foot. (It is to be understood that the lower part of the plenum extension 501 communicates freely with the full horizontal length of exhaust chamber 27 of the smoke hood apparatus, much as is shown and described relative to FIGS. 1 and 2 in connection with plenum extension 150.)

The restrictor means R of FIG. 8 are illustrated to comprise three small baffles or deflectors 508–510 which extend horizontally between the front and rear walls of plenum extension 501. Such baffles 508–510 are disposed generally beneath (and adjacent) the inlet to duct 502, being so shaped and located that the flow of air and fumes through filters 3*a* will be substantially uniform across the entire "width" of the apparatus. The central one 509 of baffles 508–510 is provided with large, unpluggable (by grease) ports or slots for self-draining purposes. Numerous sizes and shapes of restrictor means R may be employed, the exact sizes and shapes being empirically determined. In place of baffles or deflectors, the front wall (for example) of plenum extension 501 may be contoured to provide a constriction below the duct 502, this being a different form of restrictor means R.

Because of the large diameter of duct 502, in relation to the thichness or depth of the plenum extension, air and fumes tend (as noted above) to enter such duct from all portions of extension 501 and thus from the full width of the apparatus. However, because duct 502 is much closer to those filters 3*a* at the central region of the apparatus, there would (in the absence of the restrictor means R) tend to be more flow through such central filters than through those near the "sides" of the apparatus (the left and right regions shown in FIG. 8). The restrictor means R corrects this tendency and makes the flow velocity substantially uniform as stated above.

The apparatus of FIGS. 7–9 also includes an inlet plenum 515 which connects through a duct 516 to supply blower 517. The diameter of the cylindrical duct 516 is much larger than the thickness of plenum 515. Supply air therefore spreads or "splashes" to all of the upper regions of plenum 515, and then flows down through deflectors which may correspond to deflectors 39 of the above-cited U.S. Pat. No. 3,664,255.

The illustrated unitary and relatively symmetrical apparatus is such that supply blower 517 is disposed on one side of supply plenum 515, whereas exhaust blower 503 is disposed on the remote side of exhaust plenum extension 501. Members 501 and 515 therefore act as baffles, minimizing recirculation of air and fumes through the smoke hood. Furthermore, as shown in FIG. 7, the intake openings of the blowers 502 and 517 are caused to face in opposite directions.

However, as indicated in the above-cited U.S. Pat. No. 3,664,255, at least some recirculation of fume-laden air may be tolerated. This is because the intake air does not enter the kitchen, being instead substantially confined to the hood. When and if such recirculation is desired, a single large blower may be used for both supply and exhaust purposes. A certain proportion of the recirculating air is then vented to the atmosphere. Such single blower (or two blowers) may be located between (or even in) one or both of the supply plenum and the exhaust plenum extension.

It is a major feature of the present invention that the filters 3*a* operate very efficiently, particularly since flow therethrough is uniform across the entire width of the apparatus. Such filters therefore remove much grease and "smoke"from the fumes. However, where smog is a particularly acute problem, additional filter means may be provided in the form of the electrostatic precipitator shown at P in FIG. 8.

Such filter (which has many openings therethrough, as well known in the art) extends across the entire thickness and width of the exhaust plenum. It is supplied with high voltage by a voltage source V.

The precipitator P needs only infrequent cleaning because of the highly effective grease removal at regions upstream thereof. When cleaning is needed, it is relatively simple in that the precipitator P may be made up of a number of narrow and relatively short sections which will fit into a commercial dishwasher. It is emphasized that many installations do not require precipitator P.

METHOD AND APPARATUS FOR INSTALLATION

The installation method and apparatus of the invention are described relative to the embodiment of FIGS. 7–9. They are, additionally, applicable to most other embodiments.

The apparatus comprises an opening 520 (FIG. 7) in ceiling or roof 12 and which is sufficiently large to receive (have passed therethrough) the entire fully-assembled smoke hood 500. A support frame 521 is mounted on the upper roof surface, around the periphery of opening 520.

The apparatus additionally comprises a combination support and cover member 522 which is fixedly secured to the smoke hood-plenum apparatus. Member 522 is welded or soldered to the elements 501 and 515, there being openings in member 522 just sufficiently large to snugly receive such elements.

The member 522 is preferably (not necessarily) horizontal and planar, being so located on the elements 501 and 515 that the apparatus 500 will be the desired distance above the cooking appliances when the periphery of member 522 is near rail 521. Heat-insulation means may be incorporated in the member 522.

Member 522 is larger than the framed opening 520. Furthermore, a flange 523 extends downwardly from the periphery of member 522, around the frame 521. Therefore, and since water-tight welded or soldered (or other) joints are made between member 522 and elements 501–515, a weather-tight system is provided as shown in FIGS. 8 and 9.

Suitable heat-insulation and/or water-sealing means, not shown, may be provided inwardly adjacent frame 521.

Suitable leveling screws or bolts (or other means) are provided as shown at 530 in FIGS. 8 and 9, the lower screw ends resting on frame 521. The screws are threaded through the member 522.

In accordance with the method, the entire pre-manufactured, pre-tested, and fully operative assembly 500, 501, 515 and 522 is dropped downwardly so that the hood 500 passes bodily through opening 520. Screws 530 are then employed to effect leveling as well as a fine adjustment relative to elevation. Heat-insulating and/or water-sealing means are then provided inwardly adjacent frame 521.

The blowers 503 and 517 are preferably connected separately at the restaurant, being suitably supported on blocks B as shown in FIG. 9.

The described installation method and apparatus provide, in addition to the major benefits stated above, the additional advantage of reducing the fire danger caused by heat conduction to the roof or ceiling 12. The present invention provides a large space between the plenum extension 501 and the surrounding ceiling 12. This, coupled with the fact that the plenum extension 501 is relatively cool in comparison to the small-area exhaust ducts of the prior art, causes minimized fire danger due to heat condition. (It is emphasized that diluting the cooking fumes with make-up air, then passing the air and fumes relatively slowly through the ceiling via the large-size plenum extension, causes much less heat to be present near the ceiling than is the case relative to conventional smoke hoods wherein undiluted fumes are concentrated in a small duct and passed at high velocity through the ceiling.) The minimized fire hazard due to heat conduction is added to the above-stated major advantage of minimized fire hazard due to grease accumulation.

It is to be noted that, in the illustrated forms of the present invention, the thickness of the plenum extension (the thickness being represented, for example, by dimension "T" in FIG. 9) at regions adjacent exhaust chamber 27 is substantially smaller than the horizontal (front-to-rear) dimension of such chamber at the plenum-extension joint. Referring to FIG. 1, for example, the horizontal dimension at the upper portion of the exhaust chamber 27, near the joint with plenum extension 150, is substantially greater than the thickness (horizontal dimension) of such extension 150. There is therefore some increase in the velocity of air and fumes as they exhaust upwardly through ceiling 12, but such increase is normally not great — the reason being that the extension 150 extends (at least at its lower end) for substantially the full "width" of the apparatus, as shown in FIG. 2, and thus has a large cross-sectional area in a horizontal plane.

It is emphasized that the present grease hood apparatus is very "wide," so as to fit over (for example) a row of cooking appliances in a restaurant. The "width" (horizontal dimension, FIG. 2 for example) is much greater than the depth (the front-to-rear dimension as seen in FIG. 1 for example). In many cases, the "width" is at least a plurality of times (and often several times) the depth, as shown in FIG. 7. Chamber 27 (FIG. 1), and the row of grease filters 3*a* (FIG. 2), are therefore greatly horizontally elongated.

Relative to FIGS. 4, 5 and 6, it is emphasized that (in the preferred form) the exhaust plenum 27, and the filters 3*a*, are only parts of the apparatus (including air supply and director means, vortex means, etc.) described in my prior patent and patent application cited above. Such apparatus is shown schematically at 500 in FIGS. 7–9. For purposes of simplification of such FIGS. 4–6, only the elements 27 and 3*a* are shown therein.

Relative to the installation embodiment of the invention, FIGS. 7–9, additional or substitute means may be provided to take care of those situations where the architect and/or builder did not construct and/or locate the opening 520 (FIG. 7) with sufficient accuracy. For some such situations, the element 522 is not factory-welded to elements 501 and 515. Instead, element 522 is provided with a single large rectangular opening, sufficiently large to receive both elements 501 and 515 with substantial clearance for lateral and tilting adjustment. The method is then performed without the member 522 in position, and the hood 500 is supported by hangers (incorporating vertical bolts for vertical adjustment) — the hangers being supported on frame 521. Thereafter, the modified element 522 is mounted over the elements 501–515, and flashing and counterflashing are provided at such elements for sealing purposes. Ducts 502 and 516, and blowers 503 and 517, are then connected.

It is pointed out that an important purpose of frame 521 is to act as a dam or dike preventing standing water on roof 12 from leaking through opening 520.

The foregoing detailed description is to be clearly understood as given by way of illustration and example only, the spirit and scope of this invention being limited solely by the appended claims.

I claim:

1. Apparatus for exhausting fumes from a space above a cooking appliance in a room in a restaurant, which comprises:

a. filter means adapted to be mounted above a cooking appliance in a room in a restaurant, and adapted to remove grease from the air and fumes passes through said filter means,
   said grease filter means being of a type which effects both impingement and centrifugal filtering actions,
b. means to effect flow of a curtain of air across a space above said cooking appliance and toward said filter means,
   said air curtain containing fumes from said cooking appliance,
c. means to create a relatively large-diameter vortex of air and fumes above said air curtain,
   said vortex containing air and fumes from said curtain and which deflect off said filter means,
d. blower means to exhaust air and fumes to the exterior of said room, and to effect forced supply of at least air to said air curtain without depleting said room of major amounts or air, and
e. means to conduct air and fumes from said filter means to said blower means,
   said last-named means comprising means to define a plenum chamber located on the opposite side of said filter means from said cooking appliance, one major wall portion of said plenum chamber being formed by said grease filter means,
   said last-named means further comprising means to define extended plenum chamber means which greatly extends said plenum chamber,
   said extended plenum chamber means extending sufficiently far from said grease filter means that the velocity of flow through said grease filter means is substantially uniform across the entire width of the apparatus.

2. The invention as claimed in claim 1, in which said filter means of the inpingement-centrifugal type comprises a multiplicity of spaced grease-collecting surfaces shaped and disposed to effect abrupt changes in the flow directions of the grease-laden fumes passed to said surfaces from said cooking appliance, the shapes and relationships of said surfaces being such that said changes in flow directions centrifugally throw grease particles from said grease-laden fumes against said surfaces for collection thereon.

3. The invention as claimed in claim 1, in which electrostatic precipitator means are provided in at least one of said plenum chamber and said extended plenum chamber means.

4. The invention as claimed in claim 1, in which said plenum chamber and said extended plenum chamber means are devoid of air-obstructing baffles or screens.

5. The invention as claimed in claim 1, in which the width of said apparatus is in excess of 5 feet.

6. The invention as claimed in claim 1, in which the width of said apparatus is in excess of 10 feet.

7. A method of filtering grease out of the fumes from a cooking appliance in a room in a restaurant, which comprises:

a. providing filter means, comprising a multiplicity of spaced grease-collecting surfaces, across the space above a cooking appliance in a room in a restaurant,
b. effecting abrupt changes, at said surfaces, in the flow directions of grease-laden air and fumes passed to said surfaces from said cooking appliance, said changes in flow directions being caused to be such as to centrifugally throw grease particles from said grease-laden air and fumes against said surfaces for collection thereon, c. passing said air and fumes through the spaces between said surfaces and to an exhaust blower along a path which includes a large and extended plenum chamber means a region of which is relatively adjacent said filter means, d. causing the amount of extension of said plenum chamber means away from said filter means to be sufficient that the velocity of flow through said spaces is substantially uniform across the entire filter means from the portion thereof above one side of said appliance to the portion thereof above the other side of said appliance, e. effecting forced flow of air and fumes above said appliance and toward said surfaces, said forced-flow step being effected by forcing at least air from the exterior of said room directly to the vicinity of said filter means, said forced air containing, at least when it reaches said vicinity of said filter means, grease-laden fumes from said cooking appliance, and f. causing a large portion of said forced-flow air and said fumes of step (e) to vortex upwardly and then to vortex downwardly and pass through said filter means.

8. The invention as claimed in claim 7, in which said method further comprises effecting electrostatic precipitation of grease and smoke at a location within said extended plenum chamber means.

* * * * *

UNITED STATES PATENT OFFICE

CERTIFICATE OF CORRECTION

PATENT NO. : 3,952,640

DATED : April 27, 1976

INVENTOR(S) : Irvin R. Kuechler

It is certified that error appears in the above-identified patent and that said Letters Patent are hereby corrected as shown below:

Column 1, line 46, change "precipitor" to --- precipitator ---.

Column 3, line 1, change "by" to --- be ---; line 25, change "expecially" to --- especially ---.

Column 5, line 53, change "or" to --- of ---.

Column 7, line 17, change "spaces" to --- spaced ---.

Column 9, line 66, change second occurrence of "the" to --- The ---.

Column 11, line 7, change "thichness" to --- thickness ---; line 12, delete third occurrence of "the".

Column 13, line 8, after "such" and before "chamber" insert --- exhaust ---; line 10, delete third occurrence of "the".

Column 14, line 4 (line 7 of claim 1), change "passes" to --- passed ---; line 21 (line 23 of claim 1), change "or" to --- of ---; line 37 (line 2 of claim 2), change "inpingement" to --- impingement ---

Signed and Sealed this

Seventeenth Day of August 1976

[SEAL]

*Attest:*

RUTH C. MASON
*Attesting Officer*

C. MARSHALL DANN
*Commissioner of Patents and Trademarks*